US008031890B2

(12) United States Patent
Suzuki et al.

(10) Patent No.: US 8,031,890 B2
(45) Date of Patent: Oct. 4, 2011

(54) ELECTROACOUSTIC TRANSDUCER

(75) Inventors: Toshihisa Suzuki, Hamamatsu (JP); Yuusaku Ebihara, Hamamatsu (JP); Masayoshi Omura, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 965 days.

(21) Appl. No.: 11/839,149

(22) Filed: Aug. 15, 2007

(65) Prior Publication Data

US 2008/0181437 A1 Jul. 31, 2008

(30) Foreign Application Priority Data

Aug. 17, 2006 (JP) ..... P2006-222382

(51) Int. Cl.
*H04R 25/00* (2006.01)

(52) U.S. Cl. ..... 381/191; 381/190; 381/389

(58) Field of Classification Search ..... 381/191
See application file for complete search history.

(56) References Cited

U.S. PATENT DOCUMENTS

2003/0044029 A1 3/2003 Gabriel et al.
2003/0068055 A1* 4/2003 Tanabe et al. ..... 381/191
2006/0210106 A1* 9/2006 Pedersen ..... 381/355

FOREIGN PATENT DOCUMENTS

KR 10-2000-0059183 * 4/2002

* cited by examiner

*Primary Examiner* — Charles Garber
*Assistant Examiner* — Yasser Abdelaziez
(74) *Attorney, Agent, or Firm* — Dickstein Shapiro LLP

(57) ABSTRACT

An electroacoustic transducer serving as a speaker or a microphone is reduced in size and weight and is capable of generating sound with relatively high sound pressure. It is constituted of a housing having a cavity having an opening in the exterior, a fixed electrode positioned opposite to the opening of the housing, a diaphragm having an electrode positioned between the opening and the fixed electrode, and an elastic deformation portion for supporting the diaphragm with respect to the housing and for allowing the diaphragm to vibrate in the thickness direction. The fixed electrode is electrically insulated from the electrode of the diaphragm. The diaphragm is distanced from the fixed electrode by means of the elastic deformation portion placed in the balanced state. When the elastic deformation portion is subjected to elastic deformation, the diaphragm vibrates with relatively large amplitude such that it comes in contact with the fixed electrode.

5 Claims, 16 Drawing Sheets

ELECTROACOUSTIC TRANSDUCER

BACKGROUND OF THE INVENTION

1. Field of the Invention

The present invention relates to electroacoustic transducers such as speakers and microphones.

This application claims priority on Japanese Patent Application No. 2006-222382, the content of which is incorporated herein by reference.

2. Description of the Related Art

Conventionally, it is required that electroacoustic transducers such as speakers and microphones be reduced in size and weight. U.S. Patent Application Publication No. 2003/0044029 teaches an example of an electroacoustic transducer adapted to MEMS technology. This kind of electroacoustic transducer is formed using a fixed electrode (having a planar shape) and a diaphragm electrode, wherein the peripheral portions of the fixed electrode and diaphragm electrode are fixed to a ring-shaped housing and are thus positioned opposite to each other with a spacing therebetween, and wherein the fixed electrode and diaphragm electrode are arranged inside of the housing.

When the electroacoustic transducer having the aforementioned constitution serves as a speaker, the diaphragm electrode vibrates due to elastic deformation in response to a certain voltage being applied between the fixed electrode and the diaphragm electrode.

Since the peripheral portion of the diaphragm electrode is fixed in the aforementioned electroacoustic transducer, it is very difficult to produce adequate amplitude when the electroacoustic transducer serves as a speaker; hence, it is very difficult to produce sound having high sound pressure.

SUMMARY OF THE INVENTION

It is an object of the present invention to provide an electroacoustic transducer having reduced size and weight, which causes vibration of a diaphragm with relatively high amplitude.

An electroacoustic transducer of the present invention includes a housing having a cavity that is opened in the exterior, a fixed electrode having a planar shape, which is positioned opposite to the opening and which forms a part of the housing, a diaphragm having an electrode, which is positioned between the opening and the fixed electrode, and an elastic deformation portion for supporting the diaphragm with respect to the housing and for allowing the diaphragm to vibrate in its thickness direction, wherein the fixed electrode is electrically insulated from the electrode of the diaphragm, wherein the diaphragm is distanced from the fixed electrode by means of the elastic deformation portion in a balanced state, and wherein the elastic deformation portion is subjected to elastic deformation so that the diaphragm comes in contact with the fixed electrode.

When the electroacoustic transducer serves as a speaker, a DC voltage is applied between the fixed electrode and the diaphragm in advance, so that the diaphragm is attracted and attached to the fixed electrode due to electrostatic attraction exerted therebetween. In the attracted and attached condition, the elastic deformation portion produces an elastic force for distancing the diaphragm from the fixed electrode. By increasing the electrostatic attraction to be greater than the elastic force, it is possible to maintain the attracted and attached condition. Since the electrode of the diaphragm is electrically insulated from the fixed electrode, it is possible to prevent an electric current from flowing between the electrode of the diaphragm and the fixed electrode in the attracted and attached condition.

By releasing voltage applied between the fixed electrode and the diaphragm, it is possible for the electroacoustic transducer to generate sound. At this time, the diaphragm is distanced from the fixed electrode due to the elastic force of the elastic deformation portion so that the elastic deformation portion is placed in the balanced state; then, the elastic deformation portion is further deformed so that the diaphragm moves toward the position opposite to the attracted and attached position due to the inertia thereof. Due to the elastic force still being applied to the elastic deformation portion and the inertia of the diaphragm, the elastic deformation portion is further deformed so that the diaphragm moves close to the fixed electrode and is then returned to the attracted and attached position. As described above, the diaphragm vibrates so as to generate sound, which is emitted from the opening of the housing toward the exterior.

When the diaphragm vibrates and is the returned close to the fixed electrode again, it is necessary to apply a relatively high voltage between the fixed electrode and the electrode of the diaphragm again. Thus, even when energy is lost with respect to the vibration of the diaphragm due to air pressure so that the diaphragm cannot be returned to the attracted and attached position by way of the elastic force of the elastic deformation portion and the inertia of the diaphragm, it is possible for the diaphragm to be reliably attracted to the fixed electrode.

The electroacoustic transducer is further equipped with a power unit for selectively applying either an AC voltage or DC voltage between the fixed electrode and the electrode of the diaphragm, wherein the frequency of the AC voltage is substantially identical to the resonance frequency of the diaphragm based on the elastic modulus of the elastic deformation portion and the weight of the diaphragm.

When the power unit applies the AC voltage whose frequency is substantially identical to the resonance frequency between the fixed electrode and the electrode of the diaphragm in the balanced state, it is possible for the diaphragm to be efficiently attracted and attached to the fixed electrode. This is because the amplitude of the diaphragm gradually increases due to an AC electric field occurring between the fixed electrode and the electrode of the diaphragm, so that the diaphragm is moved close to the fixed electrode. When the diaphragm comes in contact with the fixed electrode, or when the diaphragm moves very close to the fixed electrode, the power unit applies the DC voltage between the fixed electrode and the electrode of the diaphragm, so that the diaphragm is attracted and attached to the fixed electrode.

In the above, prior to the generation of sound, the diaphragm is attracted and attached to the fixed electrode upon application of the AC voltage or DC voltage. This makes it possible for the diaphragm to be compulsorily attracted and attached to the fixed electrode irrespective of the elastic force of the elastic deformation portion in advance. When the diaphragm vibrates to generate sound by releasing the attracted and attached condition of the diaphragm, it is possible to reliably increase the vibration displacement of the diaphragm by use of the elastic force.

At least one of the diaphragm and the fixed electrode is formed using an electret film. That is, when voltage is applied such that an electric charge whose polarity is inverse to the polarity of permanent charge of the electret film is applied to the diaphragm and the fixed electrode, electrostatic attraction occurs due to the application of the voltage, and another electrostatic attraction is exerted between the electret film and the diaphragm or the fixed electrode. This makes it possible for the diaphragm to be attracted and attached to the fixed electrode even when the voltage applied between the diaphragm and fixed electrode is reduced. When the voltage is applied such that the electric charge whose polarity is identical to the polarity of the permanent charge of the electret film is applied to the diaphragm and the fixed electrode, it is possible to produce repulsion between the diaphragm and the fixed electrode; hence, it is possible to realize efficient operation of the electroacoustic transducer.

Alternatively, an electroacoustic transducer includes a housing having a cavity opened in the exterior, a fixed electrode having a planar shape, which is positioned opposite to the opening and which forms a part of the housing, a diaphragm that is positioned between the opening and the fixed electrode, and an elastic deformation portion for supporting the diaphragm with respect to the housing and for allowing the diaphragm to vibrate in its thickness direction, wherein the diaphragm is distanced from the fixed electrode by means of the elastic deformation portion in a balanced state, wherein the elastic deformation portion is subjected to elastic deformation such that the diaphragm comes in contact with the fixed electrode, and wherein the diaphragm is composed of an electret, which is charged in either the positive polarity or negative polarity.

In the above, when the electroacoustic transducer serves as a speaker, a DC voltage is applied such that an electric charge whose polarity is inverse to the polarity of the permanent charge of the electret is applied to the fixed electrode, so that the diaphragm is attracted and attached to the fixed electrode due to electrostatic attraction exerted between the diaphragm and the fixed electrode. In the attracted and attached condition, an elastic force occurs in the elastic deformation portion so that the diaphragm is distanced from the fixed electrode. However, by increasing the electrostatic attraction to be greater than the elastic force, it is possible to maintain the attracted and attached condition.

When the electroacoustic transducer generates sound, the aforementioned voltage is released, or voltage is applied such that an electric charge whose polarity is identical to the polarity of the permanent charge is applied to the fixed electrode to which the diaphragm is attracted, so that the diaphragm vibrates due to the inertia thereof and the elastic force of the elastic deformation portion and is thus returned to the attracted and attached position. That is, the diaphragm vibrates so that sound is emitted from the opening of the housing toward the exterior.

When the diaphragm is moved close to the fixed electrode again, a relatively high voltage is applied such that an electric charge whose polarity is inverse to the polarity of the permanent charge is applied to the fixed electrode, so that the diaphragm is reliably attracted and attached to the fixed electrode.

Since the diaphragm is compulsorily subjected to vibration from the attracted and attached state, which is initially established irrespective of the elastic force of the elastic deformation portion, it is possible to cause a relatively large amplitude of vibration with respect to the diaphragm; hence, it is possible to generate sound with relatively high sound pressure. Since the electroacoustic transducer has a simple structure in which the fixed electrode, diaphragm, and elastic deformation portion are installed in the housing, it is possible to reduce the size and weight of the electroacoustic transducer with ease. Furthermore, the electroacoustic transducer is capable of operating with low power when a reduced voltage is applied between the diaphragm and the fixed electrode.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENTS

Figure 1:
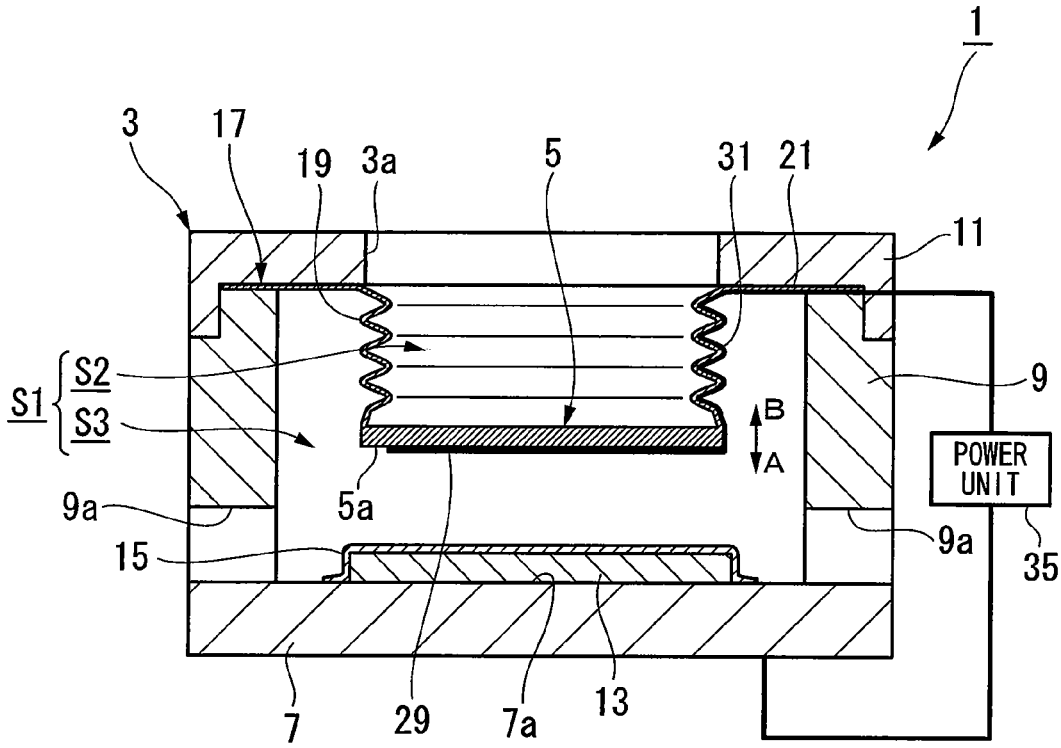
FIG. 1 is a cross-sectional view showing the constitution of an electroacoustic transducer in accordance with a first embodiment of the present invention.

The present invention will be described in further detail by way of examples with reference to the accompanying drawings.

1. First Embodiment

An electroacoustic transducer according to a first embodiment of the present invention will be described with reference to FIG. 1, FIGS. 2A-2C, and FIGS. 3 and 4. That is, an electroacoustic transducer 1 is designed such that a diaphragm 5 is arranged inside of a housing 3 having a cavity S1, which is opened externally. The housing 3 is constituted of a fixed electrode 7 having a rectangular shape (forming the bottom of the housing 3 opposite to an opening 3*a*, a cylindrically-shaped side wall 9, which is formed in the periphery of a surface 7*a* of the fixed electrode 7, and a cover 11 having the opening 3*a*, which is fixed to the upper portion of the side wall 9.

The fixed electrode 7 is composed of a conductive material, wherein an electret film 13 is formed on a surface 7*a* positioned opposite to the diaphragm 5. The electret film 13 is covered with an electrically insulating film 15. The electret film 13 is composed of an organic material such as a fluorine-contained resin or is composed of an inorganic material such as $SiO_2$, for example.

The diaphragm 5 is arranged between the opening 3*a* and the fixed electrode 7 substantially in parallel with the fixed electrode 7, wherein it is supported by the housing 3 by means of an elastic deformation portion 17, which is integrally formed with the diaphragm 5. The elastic deformation portion 17 includes a bellows portion 19 substantially having a cylindrical shape and a flange 21 having a membrane shape, which project externally from the upper portion thereof in a radial direction. The external circumferential portion of the flange 21 is fixed and sandwiched between the upper portion of the side wall 9 and the cover 11. Thus, the upper end of the bellows portions 19 is fixed to the circumferential portion of the opening 3*a* of the cover 11.

The lower end of the bellows portion 19 is integrally interconnected to the external circumferential portion of the diaphragm 5, whereby the diaphragm 5 is hung down from the circumferential portion of the opening 3*a* of the cover 11 by means of the bellows portion 19. The bellows portion 19 is formed in an elastically deformed manner so that the diaphragm 5 can vibrate in the thickness direction (i.e., direction A-B).

Figure 3:
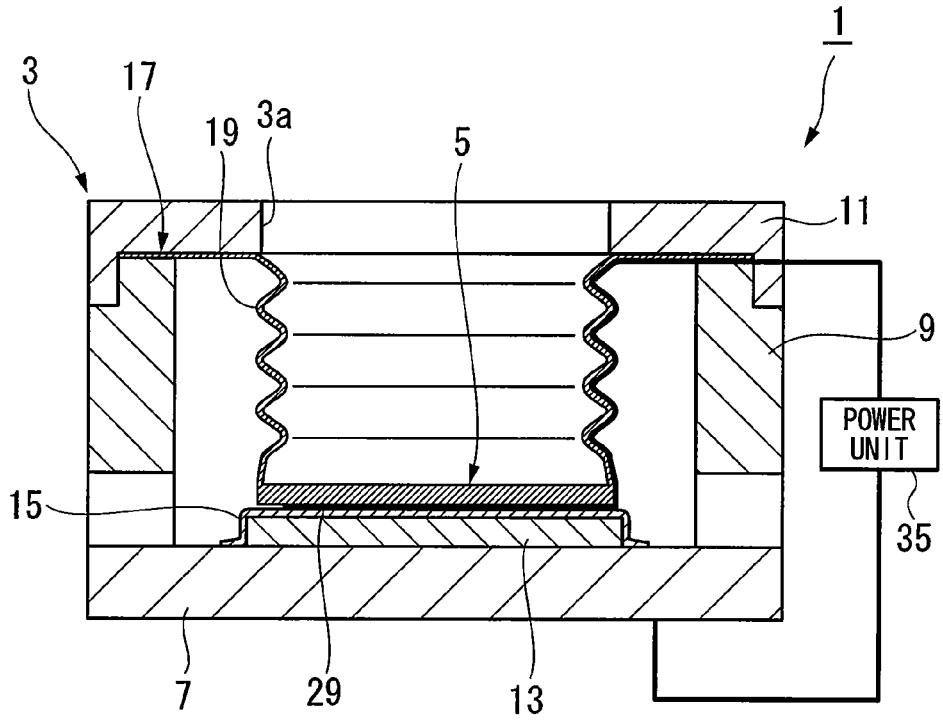
FIG. 3 is a cross-sectional view showing that the diaphragm is attracted and attached to a fixed electrode in the electroacoustic transducer.
Figure 4:
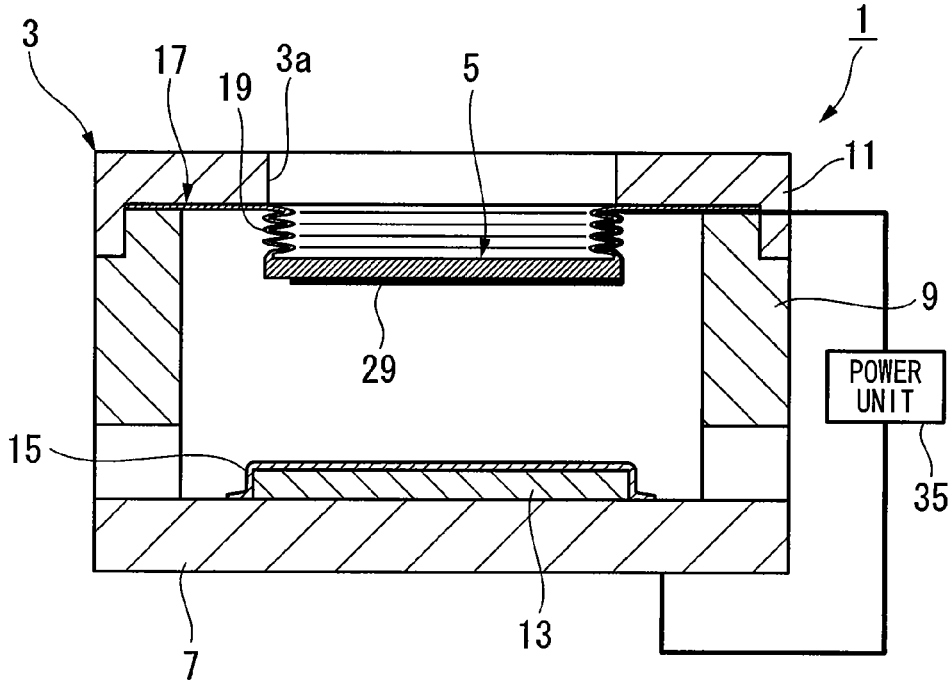
FIG. 4 is a cross-sectional view showing that the diaphragm is distanced from the fixed electrode in the electroacoustic transducer.

In a balanced state in which no elastic force is applied to the bellows portion 19, the elastic deformation portion 17 makes the diaphragm 5 retract away from the fixed electrode 7. As shown in FIG. 3, the bellows portion 19 of the elastic deformation portion 17 can be expanded due to elastic deformation so that the diaphragm 5 comes in contact with the fixed electrode 7.

Figure 2A:
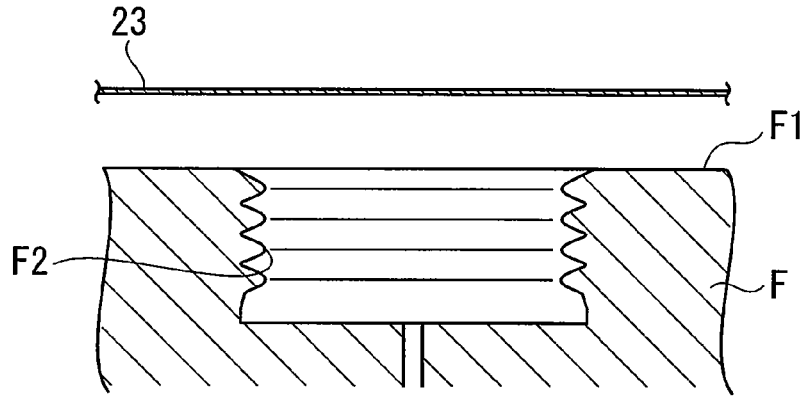
FIG. 2A is a cross-sectional view for explaining a first step of a manufacturing method of a diaphragm and an elastic deformation portion of the electroacoustic transducer shown in FIG. 1.

The diaphragm 5 and the elastic deformation portion 17 having the aforementioned constitutions can be integrally formed by use of a mold F shown in FIG. 2A. The mold F has a recess F2 that concaves away from a surface F1, wherein the interior wall of the recess F2 is formed in a bellows manner.

Figure 2B:
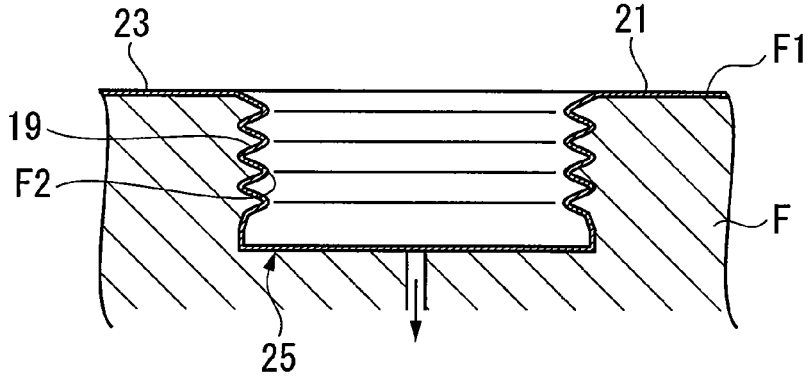
FIG. 2B is a cross-sectional view for explaining a second step of the manufacturing method of the electroacoustic transducer.

In the formation of the diaphragm 5 and the elastic deformation portion 17 by use of the mold F, a polyimide film 23 having a membranous shape is arranged on the surface F1 of the heated mold F; and air in the recess F2 is evacuated, so that the polyimide film 23 is shaped to match the bottom and bellows of the recess F2 as shown in FIG. 2B. The polyimide film 23, which is shaped in conformity with the shape of the recess F2, is cooled and is then extracted from the recess F2, whereby it is possible to integrally form the bellows portion 19 having a cylindrically-bottomed portion 25 and the flange 21.

Figure 2C:
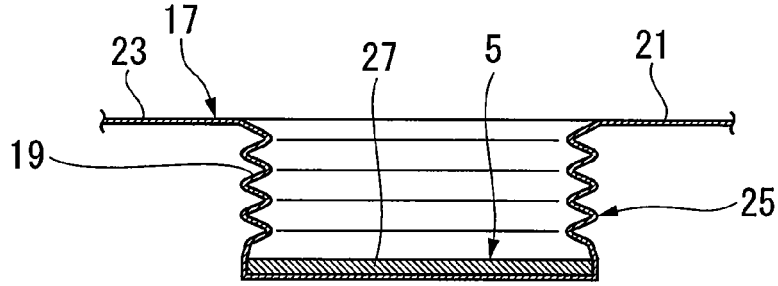
FIG. 2C is a cross-sectional view for explaining a third step of the manufacturing method of the electroacoustic transducer.

Lastly, as shown in FIG. 2C, solidification is performed by introducing a liquid glass epoxy resin into the bottom of the cylindrically-bottomed portion 25, thus forming the planar diaphragm 5, which is not elastically deformed, in the lower end of the bellows portion 19.

As shown in FIG. 1, the diaphragm 5 has an electrode 29, which is formed on the surface 5*a* of the diaphragm 5 positioned opposite to the electret film 13 and the fixed electrode 7. The electrode 29 is connected to a wire 31 formed on the external circumferential surface of the bellows portion 19 and the surface of the flange 21. The electrode 29 and the wire 31 can be formed by way of gold plating or deposition.

Both of the fixed electrode 7 and the electrode 29 of the diaphragm 5 are connected to a power unit 35, which can selectively apply an AC voltage or DC voltage between the fixed electrode 7 and the electrode 29. The power unit 35 is designed to turn on or off the voltage applied to the fixed electrode 7 and the electrode 29. Herein, the frequency of the AC voltage supplied from the power unit 35 is substantially identical to the resonance frequency of the diaphragm 5 based on the elastic modulus of the bellows portion 19 and the weight of the diaphragm 5.

Even when the bellows portion 19 is elastically deformed so that the diaphragm 5 comes in contact with the fixed electrode 7 as shown in FIG. 3, the electrode 29 of the diaphragm 5 comes in contact with an insulating film 15 of the fixed electrode 7, so that the fixed electrode 7 is electrically insulated from the electrode 29 of the diaphragm 5. For this reason, even when the power unit 35 applies the voltage between the fixed electrode 7 and the electrode 29 of the diaphragm 5, electrical short-circuiting is unlikely to occur therebetween.

The cavity S1 of the housing 3 is partitioned into a space S2 (positioned in proximity to the opening 3*a*) and a back space S3 (positioned in proximity to the fixed electrode 7) by means of the diaphragm 5 having the aforementioned constitution and the elastic deformation portion 17. A plurality of holes 9*a* are formed in the side wall 9 so as to allow communication between the back space S3 and the exterior, thus preventing vibration of the diaphragm 5 from being disturbed due to an increase and decrease of pressure applied to the back space S3. Due to the formation of the holes 9*a* in the side wall 9, it is possible to emit sound from the holes 9*a* due to the vibration of the diaphragm 5.

Next, the operation of the electroacoustic transducer 1 having the aforementioned constitution, which serves as a speaker, will be described.

In the electroacoustic transducer 1, a permanent charge is formed in the electret film 13 by way of a high voltage or corona discharge in advance. Specifically, a negative charge is concentrated at the surface of the electret film 13 opposite to the diaphragm 5, while a positive charge is concentrated at the backside of the electret film 13 that comes in contact with the fixed electrode 7.

Before sound emission, in the condition in which the bellows portion 19 of the elastic deformation portion 17 is elastically deformed and expanded so that the diaphragm 5 comes in contact with the fixed electrode 7 as shown in FIG. 3, the power unit 35 applies a DC voltage between the fixed electrode 7 and the electrode 29 of the diaphragm 5, so that the diaphragm 5 is attracted and attached to the fixed electrode 7 due to electrostatic attraction exerted between the diaphragm 5 and the fixed electrode 7.

In the attracted and attached condition, the DC voltage is applied in such a way that a charge whose polarity is inverse to the polarity of the permanent charge concentrated at the surface of the electret film 13 is concentrated at the electrode 29 of the diaphragm 5. For example, when a negative charge is concentrated at the surface of the electret film 13, the DC voltage is applied such that a positive charge is concentrated at the diaphragm 5. This realizes electrostatic attraction exerted between the electret film 13 and the diaphragm 5 in addition to electrostatic attraction caused by applying the DC voltage; hence, it is possible to reliably fix the diaphragm 5 to the fixed electrode 7 even when the voltage applied between the diaphragm 5 and the fixed electrode 7 is reduced.

In the aforementioned condition, the elastic force is applied to the bellows portion 19 such that the diaphragm 5 is separated from the fixed electrode 7. By increasing the sum of electrostatic attractions so as to be higher than the elastic force, it is possible to maintain the attracted and attached condition. Since the fixed electrode 7 is electrically insulated from the electrode 29 of the diaphragm 5 by means of the insulating film, substantially no current may flow between the fixed electrode 7 and the electrode 29 of the diaphragm 5 in the attracted and attached condition.

In order to generate sound by means of the electroacoustic transducer 1, the power unit 35 releases a voltage applied between the fixed electrode 7 and the diaphragm 5 in the aforementioned condition. At this time, the diaphragm 5 is separated from the fixed electrode 7 due to the elastic force of the bellows portion 19; hence, the bellows portion 19 is positioned in the balanced state as shown in FIG. 1; then, due to the inertia of the diaphragm 5, the bellows portion 19 is further deformed toward the position opposite to the attracted and attached position. In this state, the elastic force is still applied to the bellows portion 19; hence, the diaphragm 5 is deformed in the direction toward the fixed electrode 7 due to the elasticity of the bellows portion 19 and the inertia of the diaphragm 5, whereby it is returned to the attracted and attached position shown in FIG. 3 again. As described above, the vibration of the diaphragm 5 causes sound to be emitted from the opening 3*a* of the housing 3 to the exterior.

When the diaphragm 5 vibrates and is thus returned to proximity of the fixed electrode 7, it is necessary to apply a high DC voltage between the fixed electrode 7 and the electrode 29 of the diaphragm 5 again. Thus, it is possible to reliably attract and fix the diaphragm 5 to the fixed electrode 7 even when energy is lost due to air resistance during the vibration of the diaphragm 5, so that the diaphragm 5 cannot be returned to the attracted and attached position due to the elasticity of the bellows portion 19 and the inertia of the diaphragm 5.

In order to generate sound by means of the electroacoustic transducer 1, it is possible to apply a predetermined voltage to the electrode 29 of the diaphragm 5 of which charge whose polarity is identical to the polarity of the permanent charge concentrated at the surface of the electret film 13 appears. This causes repulsion between the diaphragm 5 and the fixed electrode 7; hence, it is possible to realize efficient operation of the electroacoustic transducer 1.

In order for the diaphragm 5, which is once positioned in the balanced state as shown in FIG. 1 to be attracted and attached to the fixed electrode 7 as shown in FIG. 3 in the electroacoustic transducer 1, it is necessary for the power unit 35 to apply an AC voltage whose frequency is substantially identical to the resonance frequency of the diaphragm 5.

That is, when the aforementioned AC voltage is applied between the fixed electrode 7 and the diaphragm 5 in the balanced state of the diaphragm 5, the amplitude of the diaphragm 5 gradually increases due to an AC electric field being applied between the fixed electrode 7 and the electrode 29 of the diaphragm 5; hence, the diaphragm 5 can move close to the fixed electrode 7. When the diaphragm 5 comes in contact with the fixed electrode 7, or when the diaphragm 5 moves very close to the fixed electrode 7, the power unit 35 applies a DC voltage between the fixed electrode 7 and the electrode 29 of the diaphragm 5, so that the diaphragm 5 is reliably attracted and attached to the fixed electrode 7.

In order to realize the absorption and fixation, it is necessary to apply a predetermined voltage so that an electrostatic attraction is applied between the electrode 29 of the diaphragm 5, which is in the balanced state, and the fixed electrode 7. In this case, it is possible to move the diaphragm 5 by way of an electrostatic attraction exerted between the electrode 29 of the diaphragm 5 and the electret film 13. This makes it possible to reduce the applied voltage in the electroacoustic transducer 1 compared with another electroacoustic transducer not having the electret film 13.

Prior to sound emission, the aforementioned electroacoustic transducer 1 can cause vibration of the diaphragm 5, which is compulsorily attracted and attached to the fixed electrode 7 irrespective of the elasticity of the bellows portion 19 in advance; hence, it is possible to realize a relatively high amplitude of the diaphragm 5. This makes it possible to increase the displacement of the diaphragm 5 so as to generate sound at a relatively high sound pressure.

Since the electroacoustic transducer 1 has a simple structure in which the housing 3 includes the fixed electrode 7, the diaphragm 5, and the elastic deformation portion 17, it can be easily reduced in size and weight.

Even when the diaphragm 5 is placed in the balanced state, the power unit 35 applies the AC voltage whose frequency is substantially identical to the resonance frequency of the diaphragm 5, so that the diaphragm 5 can be efficiently attracted and attached to the fixed electrode 7.

Due to the provision of the electret film 13, it is possible to reduce the voltage applied to the electroacoustic transducer 1 such as a predetermined voltage for attracting and fixing the diaphragm 5, which is initially placed in the balanced state, to the fixed electrode 7 and a predetermined voltage for maintaining the attracted and attached condition of the diaphragm 5. That is, the present embodiment makes it possible for the electroacoustic transducer 1 to operate with low power.

The present embodiment is designed such that the diaphragm 5 is attracted and attached to the fixed electrode 7 by applying an AC voltage between the diaphragm 5 and the fixed electrode 7 prior to sound emission. However, the present invention is not necessarily limited to the present embodiment. That is, the present embodiment can be modified such that the diaphragm 5 is attracted and attached to the fixed electrode 7 by applying the DC voltage between the diaphragm 5 and the fixed electrode 7.

The present embodiment is designed such that the electret film 13 is formed on the surface 7*a* of the fixed electrode 7 positioned opposite to the diaphragm 5. Instead, the present embodiment can be modified such that the electret film 13 is formed on the surface 5*a* of the diaphragm 5 positioned opposite to the fixed electrode 7. In this constitution, it is preferable that the electret film 13 be arranged to cover the electrode 29 of the diaphragm 5. In addition, it is preferable that the electret film 13 be covered with the insulating film 15. With such a modification, it is possible to reduce the voltage applied between the diaphragm 5 and the fixed electrode 7; this makes it possible for the electroacoustic transducer 1 to operate with low power.

The present embodiment is designed such that the diaphragm 5 and the fixed electrode 7 are formed by way of the formation of the electret film 13; however, the electret film 13 does not need to be formed. When the electret film 13 is not formed, it is necessary to form the insulating film 15 on either the surface 5*a* of the diaphragm 5 or the surface 7*a* of the fixed electrode 7, thus avoiding the occurrence of short-circuiting between the fixed electrode 7 and the electrode 29 of the diaphragm 5. In order to attract the diaphragm 5 to the fixed electrode 7 with a low voltage, it is preferable that the insulating film 15 be reduced in thickness. Specifically, it is preferable that the thickness of the insulating film 15 be set to several micro-meters.

In the present embodiment, the elastic deformation portion 17 is composed of the polyimide film 23; however, this is not a restriction. That is, it is required that the elastic deformation portion 17 be composed of a prescribed material realizing elastic deformation.

In the present embodiment, the diaphragm 5 is composed of the polyimide film 23 and the glass epoxy resin 27; however, this is not a restriction. That is, it is required that the diaphragm 5 be formed in a planar shape that does not cause elastic deformation.

In the present embodiment, the electrode 29 is attached to the surface 5*a* of the diaphragm 5; however, this is not a restriction. That is, it is possible to form the diaphragm 5 by use of a conductive material, so that the diaphragm 5 can entirely serve as an electrode.

2. Second Embodiment

An electroacoustic transducer according to a second embodiment of the present invention will be described with reference to FIGS. 5 and 6. An electroacoustic transducer 41 of the second embodiment differs from the electroacoustic transducer 1 of the first embodiment in terms of the constitutions of the diaphragm and elastic deformation portion. In the following description, only the difference between the first and second embodiments will be described while the same parts as those of the first and second embodiments are designated by the same reference numerals, hence, the description thereof will be omitted.

Figure 5:
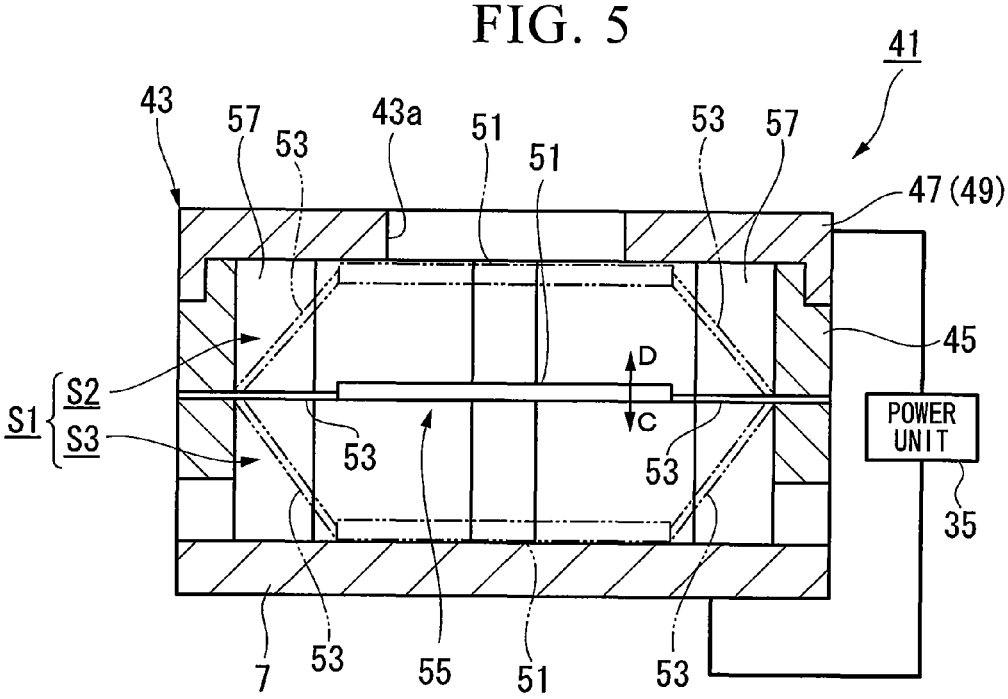
FIG. 5 is a cross-sectional view showing the constitution of an electroacoustic transducer in accordance with a second embodiment of the present invention.

In FIG. 5, a housing 43 of the electroacoustic transducer 41 includes a cover 47 having a cylindrically-shaped side wall 45 and an opening 43*a* in addition to the fixed electrode 7 (which is used in the electroacoustic transducer 1).

The cover 47 is composed of a conductive material so as to form an electrode 49 positioned opposite to the fixed electrode 7. Similar to the electroacoustic transducer 1, the fixed electrode 7 and the electrode 49 used in the electroacoustic transducer 41 are connected to the power unit 35. That is, the power unit 35 applies a voltage between the fixed electrode 7 and the electrode 49 in the electroacoustic transducer 41. A plurality of elastic deformation portions 53 are fixed to the interior of the side wall 45.

Figure 6:
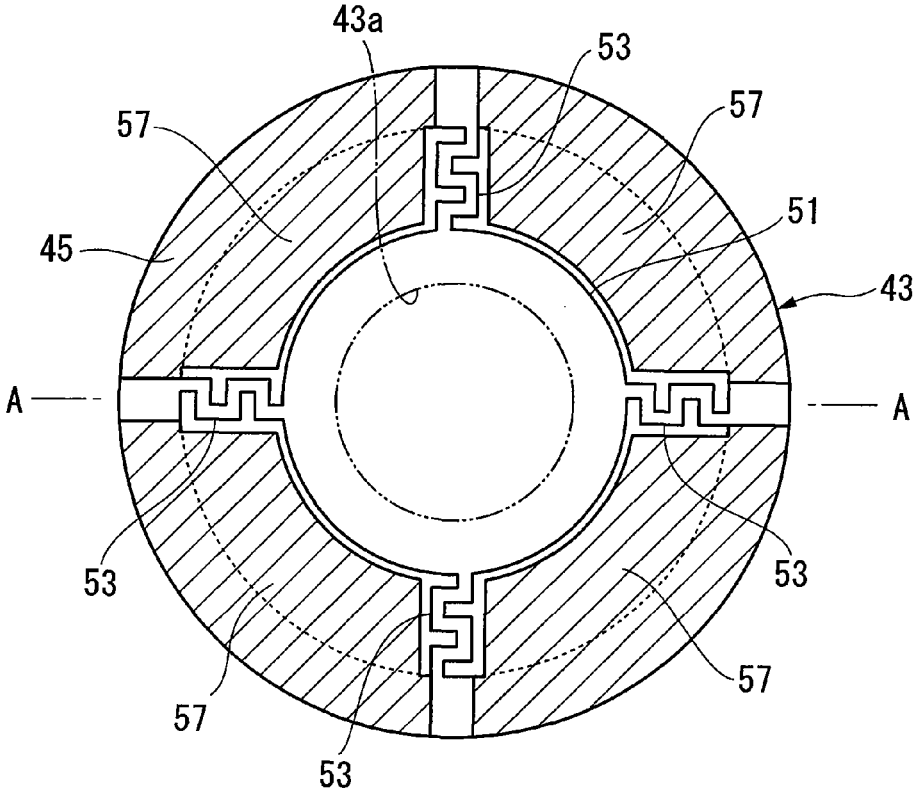
FIG. 6 is a horizontal sectional view of the electroacoustic transducer in view of an opening of the housing.

As shown in FIGS. 5 and 6, a diaphragm 51 is arranged between the cover 47 including the opening 43*a* and the fixed electrode 7 so that it is placed substantially in parallel with the fixed electrode 7 and the electrode 49. Specifically, the diaphragm 51 is supported by the housing 43 by means of four elastic deformation portions 53. The diameter of the diaphragm 51 having a circular shape in plan view is larger than the diameter of the opening 43*a*.

The elastic deformation portions 53 are elongated in a plane direction from the circumferential periphery of the diaphragm 51, wherein the distal ends thereof are fixed to the side wall 45 of the housing 43. Each of the elastic deformation portions 53 meanders from the diaphragm 51 to the side wall 45; hence, each of them can be elastically deformed with ease. The elastic deformation portions 53, which are integrally formed together with the diaphragm 51, are arranged in a circumferential direction of the diaphragm 51 with equal spacing therebetween.

Due to elastic deformation of the elastic deformation portions 53, the diaphragm 51 can vibrate in the thickness direction (i.e., direction C-D shown in FIG. 5), wherein the elastic deformation portions 53 allow the diaphragm 51 to be elastically deformed and expanded in contact with the fixed electrode 7 or the electrode 49. In the balanced state in which an elastic force is not applied to each of the elastic deformation portions 53, the diaphragm 51 is distanced from the fixed electrode 7 and the electrode 49 respectively. Specifically, in the balanced state, the diaphragm 51 is positioned at the same distance from the fixed electrode 7 and the electrode 49 respectively.

Both of the diaphragm 51 and the elastic deformation portions 53 are integrally formed together by means of an electret 55 composed of an organic material such as a fluorine-contained resin or composed of an inorganic material such as $SiO_2$. The diaphragm 51 and the elastic deformation portions 53 can be integrally formed by way of etching of the electret 55 having a planar shape by use of a resist pattern forming the diaphragm 51 and the elastic deformation portions 53. Herein, etching is performed with respect to the elastic deformation portions 53, each having a thickness that is reduced to realize elastic deformation.

Since the diaphragm 51 is composed of the electret 55 (i.e., a dielectric), the electric charge may not move between the diaphragm 51 and the fixed electrode 7 or the electrode 49 even when the diaphragm 51 comes in contact with the fixed electrode 7 or the electrode 49.

A plurality of partition plates 57, which project inwardly of the side wall 45, are formed to occupy the gap formed between the diaphragm 51 and the side wall 45. The diaphragm 51 and the partition plates 57 are arranged to partition the cavity S1 into the cavity S2 in proximity to the opening 43*a* and the back cavity S3 in proximity to the fixed electrode 7. That is, they prevent air flow from occurring between the cavity S2 and the back cavity S3.

Next, the operation of the electroacoustic transducer 41, which serves as a speaker, will be described. In the electroacoustic transducer 41, the diaphragm 51 composed of the electret 55 is subjected to a high voltage or corona discharge and is thus charged with either the positive polarity or negative polarity in advance.

In addition, a DC voltage is applied to the fixed electrode 7 so that a charge whose polarity is inverse to the polarity of a permanent charge of the electret 55 is applied to the fixed electrode 7 in the condition in which the elastic deformation portions 53 are elastically deformed and expanded so that the diaphragm 51 comes in contact with the fixed electrode 7, whereby the diaphragm 51 is attracted and attached to the fixed electrode due to an electrostatic attraction exerted between the diaphragm 51 and the fixed electrode 7. In the attracted and attached condition, an elastic force occurs in the elastic deformation portions 53 so as to distance the diaphragm 51 from the fixed electrode 7. However, the attracted and attached condition can be maintained by increasing the electrostatic attraction to be greater than the elastic force.

In the second embodiment, similar to the first embodiment, the electroacoustic transducer 41 is capable of generating sound when the power unit 35 releases the voltage applied between the fixed electrode 7 and the electrode 49 because the diaphragm 51 vibrates due to the elastic force of the elastic deformation portions 53 and the inertia thereof so that the diaphragm 51 is returned to the attracted and attached position. That is, vibration of the diaphragm 51 causes sound, which is emitted from the opening 43*a* of the housing 43 toward the exterior.

When the diaphragm 51 vibrates and is thus moved close to the fixed electrode 7, the DC voltage is applied between the fixed electrode 7 and the electrode 49 again, thus reliably fixing the diaphragm 51 to the fixed electrode 7.

Incidentally, the electroacoustic transducer 41 is capable of generating sound upon the application of the voltage such that the electric charge whose polarity is identical to the polarity of permanent charge of the electret 55 is applied to the fixed electrode 7 in the attracted and attached condition of the diaphragm 51. In this case, repulsion occurs between the diaphragm 51 and the fixed electrode 7 so as to realize efficient operation of the electroacoustic transducer 41.

In the electroacoustic transducer 41, the diaphragm 51, which is once placed in the balanced state, is attracted and attached to the fixed electrode 7 when the power unit 35 applies the AC voltage whose frequency is identical to the resonance frequency of the diaphragm 51 between the fixed electrode 7 and the electrode 49.

When the AC voltage is applied between the fixed electrode 7 and the electrode 49 in the balanced state of the diaphragm 51, the amplitude of the diaphragm 51 gradually increases due to an AC electric field being applied between the fixed electrode 7 and the diaphragm 51 or between the electrode 49 and the diaphragm 51, so that the diaphragm 51 moves close to the fixed electrode 7 or the electrode 49. When the diaphragm 51 comes in contact with the fixed electrode 7, or when the diaphragm 51 moves very close to the fixed electrode 7, the power unit 35 applies a voltage between the fixed electrode 7 and the electrode 49 in such a way that an electric charge whose polarity is inverse to the polarity of permanent charge of the electret 55 is applied to the fixed electrode 7, so that the diaphragm 51 is reliably attracted to the fixed electrode 7.

The electroacoustic transducer 41 of the second embodiment provides effects similar to those of the electroacoustic transducer 1 of the first embodiment. In this constitution, when the power unit 35 applies an AC voltage whose frequency is identical to the resonance frequency of the diaphragm 51 between the fixed electrode 7 and the electrode 49 in the balanced state of the diaphragm 51, it is possible to efficiently increase the amplitude of the diaphragm 51 due to an AC electric field being applied between the electrode 49 and the diaphragm 51 in addition to an AC electric field being applied between the fixed electrode 7 and the diaphragm 51. Compared with the electroacoustic transducer 1 of the first embodiment, the electroacoustic transducer 41 of the second embodiment allows the diaphragm 51 to be attracted and attached to the fixed electrode 7 in a short period of time.

The electroacoustic transducer 41 of the second embodiment is designed such that the entire area of the cover 47 forms the electrode 49 positioned opposite to the fixed electrode 7; but this is not a restriction. That is, the second embodiment requires that at least a prescribed portion of the cover 47 corresponding to the peripheral portion of the opening 43*a* of the housing 43 forms an electrode positioned opposite to the fixed electrode 7, allowing the diaphragm 51 to come in contact with the electrode due to the elastic deformation of the elastic deformation portions 53.

Each of the elastic deformation portions 53 is not necessarily formed in a meandering shape elongated in the radial direction of the diaphragm 51. For example, it is formed in a meandering shape elongated in a direction along a part of the external periphery of the diaphragm 51, or it is formed in a corrugated shape.

In the second embodiment, the elastic deformation portions 53 are each formed using the electret 55, which is also used for the formation of the diaphragm 51; but this is not a restriction. That is, both of the elastic deformation portions 53 and the diaphragm 51 can be formed using the same material, or they can be formed using different materials. That is, the second embodiment simply requires that the elastic deformation portions 53 be elastically deformable together with the diaphragm 51 by appropriately selecting shapes and materials thereof.

In the second embodiment, the diaphragm 51 is entirely formed using the electret 55; but this is not a restriction. That is, the second embodiment requires that at least a part of the diaphragm 51 be formed using the electret 55.

3. Variations

Figure 7:
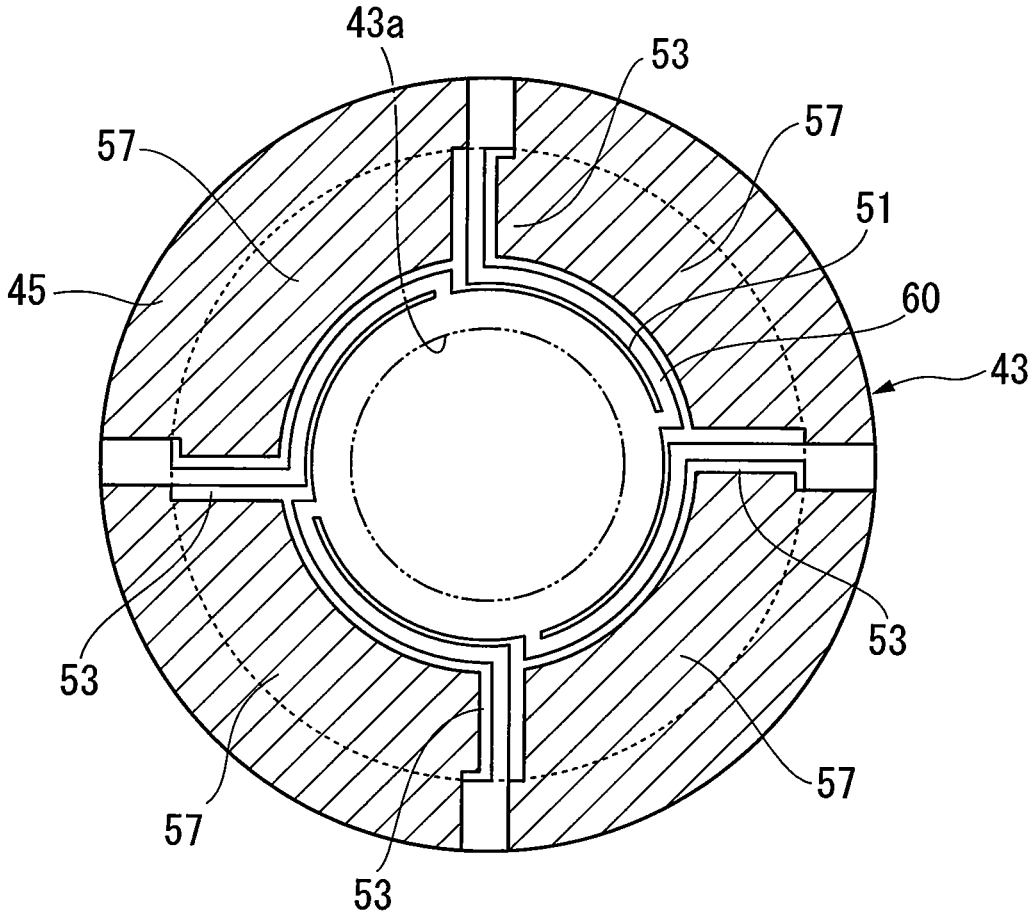
FIG. 7 is a horizontal sectional view of the electroacoustic transducer in accordance with one variation of the present invention.
Figure 8:
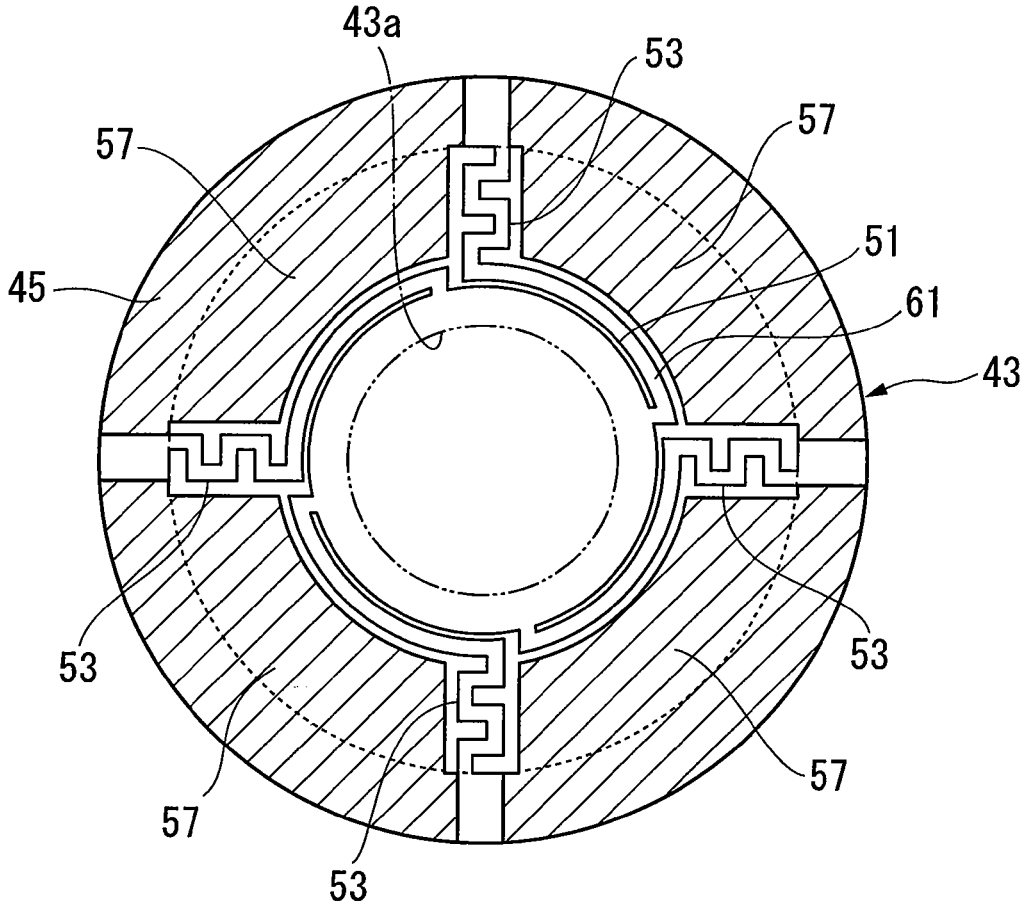
FIG. 8 is a horizontal sectional view of the electroacoustic transducer in accordance with another variation of the present invention.
Figure 9:
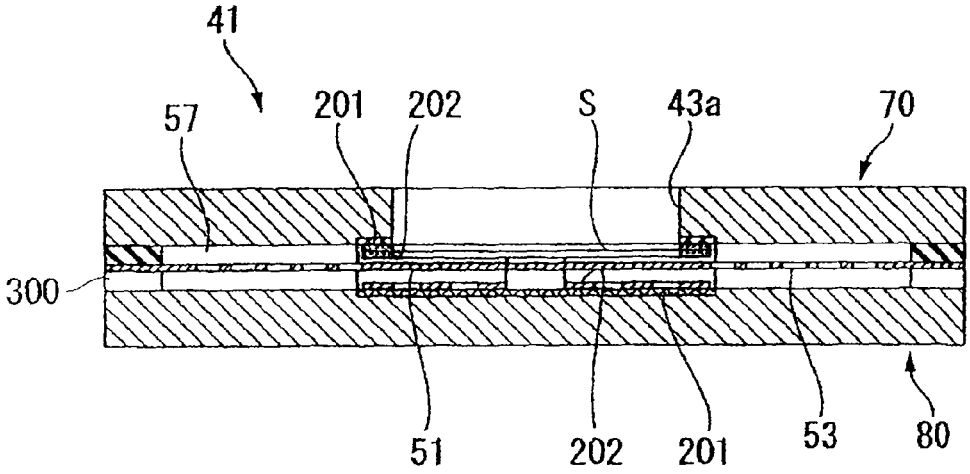
FIG. 9 is a cross-sectional view showing the constitution of the electroacoustic transducer that is produced by combining an upper substrate and a lower substrate.
Figure 10A:
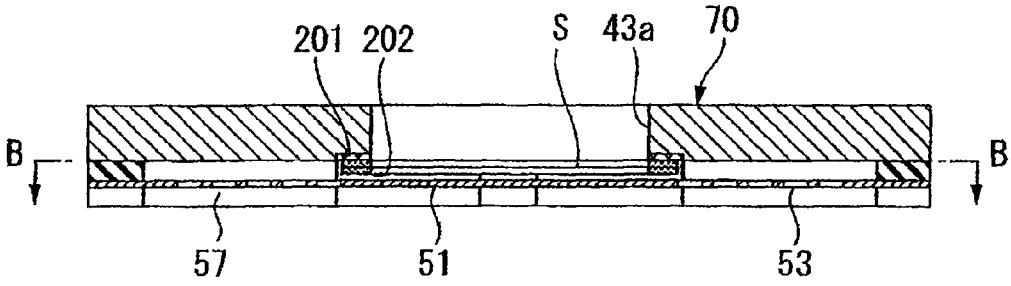
FIG. 10A is a cross-sectional view showing the constitution of the upper substrate.
Figure 10B:
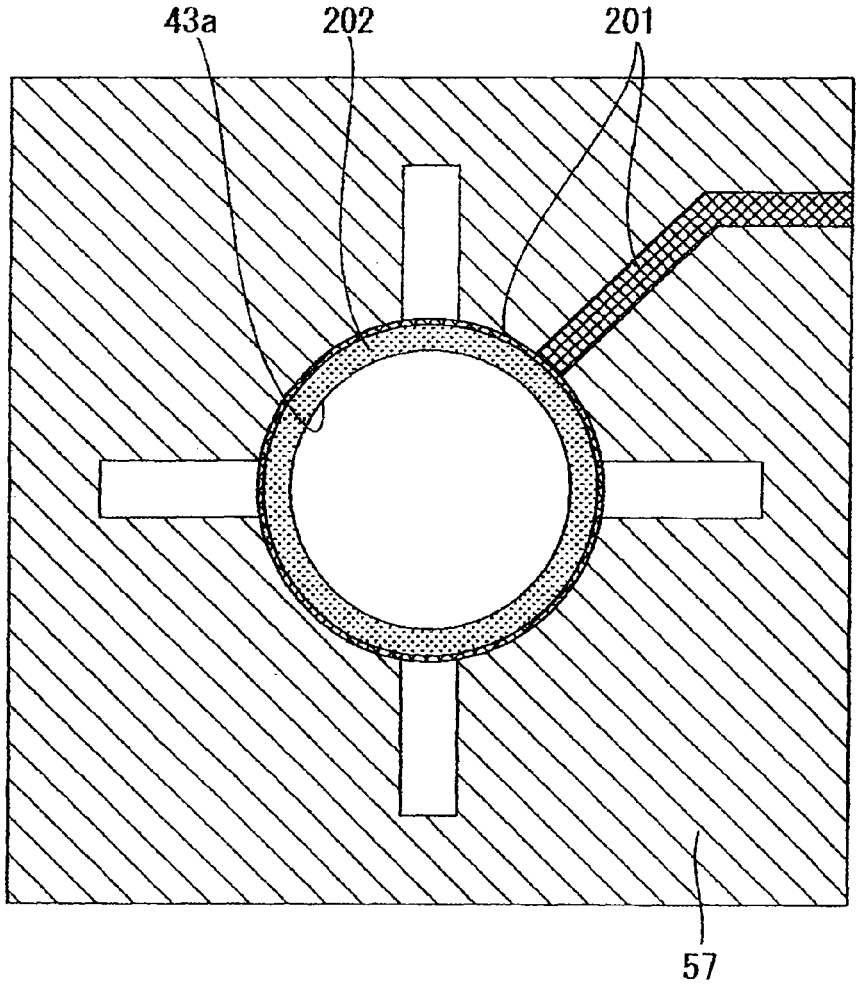
FIG. 10B is a horizontal sectional view taken along line B-B in FIG. 10A.
Figure 10C:
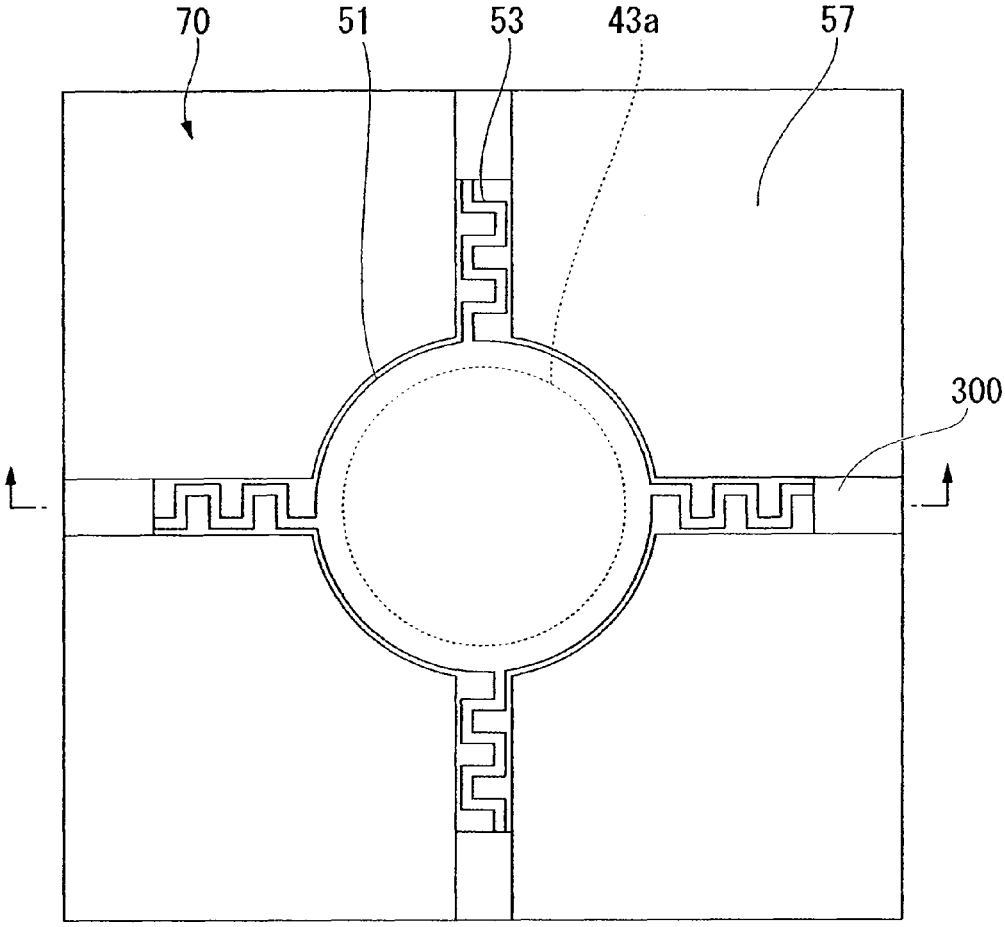
FIG. 10C is a plan view showing the upper substrate.

It is not necessary that the elastic deformation portions 53 be directly connected to the diaphragm 51; that is, it is possible to design variations as shown in FIGS. 7 and 8, wherein the elastic deformation portions 53 are connected to the diaphragm 51 via supports 60, each of which is elongated along a prescribed part of the circumferential periphery of the diaphragm 51. In case of FIG. 7, the elastic deformation portions 53 are each formed in a linear shape extending in a radial direction of the diaphragm 51, wherein they are connected to the diaphragm 51 via the supports 60. Each of the supports 60 is arranged between the adjacently arranged two elastic deformation portions 53, wherein one end of each support 60 is connected to one elastic deformation portion 53 via a gap, while the other end of each support 60 is connected to the other elastic deformation portion 53. The elastic deformation portions 53 and the supports 60 are each surrounded by the partition plats 57 with a prescribed gap therebetween, wherein the partition plates 57 are formed to suit the shapes of the elastic deformation portions 53 and the shapes of the supports 60. That is, the diaphragm 51 is connected to the elastic deformation portions 53 via the supports 60, and the peripheries of the elastic deformation portions 53 and the supports 60 are surrounded by the partition plates 57, whereby the amplitude of the diaphragm 51 is further increased, and air resistances are formed due to the gaps between the partition plats 57 and the elastic deformation portions 53 and the supports 60. This makes it possible to control the air flow toward the back cavity S3 in proximity to the fixed electrode 7 when the diaphragm 51 moves from the fixed electrode 7 to the electrode 49.

In case of FIG. 8, the elastic deformation portions 53 are each formed in a meandering shape toward the side wall 45, wherein they are connected to the diaphragm 51 via a plurality of supports 61, each of which is elongated along a prescribed part of the circumferential periphery of the diaphragm 51. This makes it possible to further increase the amplitude of the diaphragm 51.

In the variations, the elastic deformation portions 53 are each formed using the electret 55, which is also used for the formation of the diaphragm 51; but this is not a restriction. That is, both of the elastic deformation portions 53 and the diaphragm 51 can be formed using the same material, or they can be formed using different materials. That is, the variations simply require that the elastic deformation portions 53 be elastically deformable together with the diaphragm 51 by appropriately selecting shapes and materials thereof.

In the variations, the diaphragm 51 is entirely formed using the electret 55; but this is not a restriction. That is, the variations require that at least a part of the diaphragm 51 be formed using the electret 55.

Each of the diaphragm 51 and the elastic deformation portions 53 is of an electrostatic capacitance type, in which it is partially formed using the electret 55; but this is not a restriction. That is, the diaphragm 51 can be designed as a condenser type, wherein the diaphragm 51 is formed using conductive materials and is connected to an external terminal (not shown). Herein, the diaphragm 51 can vibrate by varying the voltage applied between the diaphragm 51, the fixed electrode 7, and the opposite electrode 49.

4. Manufacturing Method

Next, the manufacturing method of the electroacoustic transducer 41 that is manufactured using a silicon substrate by way of semiconductor manufacturing processes will be described with reference to FIG. 9, FIGS. 10A, 10B, and 10C, and FIGS. 11A and 11B.

Figure 12A:
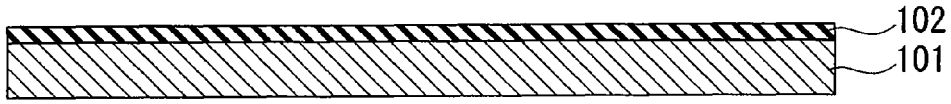
FIG. 12A is a cutting plane showing a first step of a manufacturing method of the electroacoustic transducer.

An upper substrate 70 (see FIG. 10A) is formed in such a way that an insulating film 102 is formed on the surface of a p-type polysilicon substrate whose thickness ranges from 500 μm to 600 μm (see FIG. 12A). It is preferable that the insulating film 102 be formed by vertically laminating a silicon nitride film on a silicon oxide film. The thickness of the insulating film 102 ranges from 5 μm to 25 μm; preferably, it is set to 10 μm.

Figure 12B:
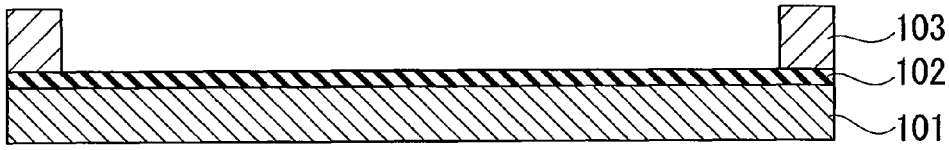
FIG. 12B is a cutting plane showing a second step of the manufacturing method of the electroacoustic transducer.
Figure 12C:
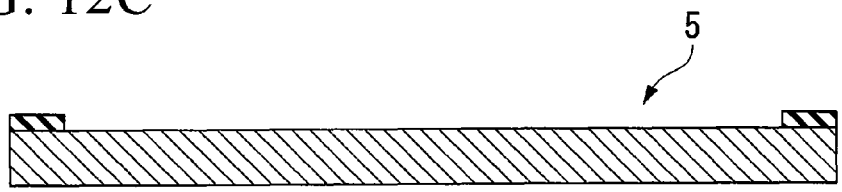
FIG. 12C is a cutting plane showing a third step of the manufacturing method of the electroacoustic transducer.

The partition plates 57 are formed in proximity to the opening 43*a* in such a way that etching is performed using a resist mask so as to form the recess S (see FIGS. 12B and 12C). After completion of the etching, the resist mask is removed.

Figure 12D:
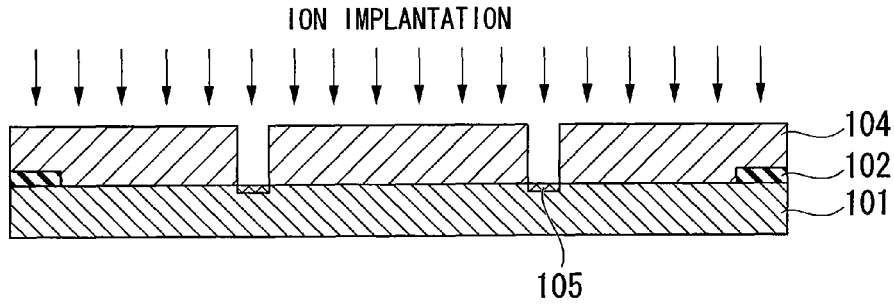
FIG. 12D is a cutting plane showing a fourth step of the manufacturing method of the electroacoustic transducer.
Figure 12E:
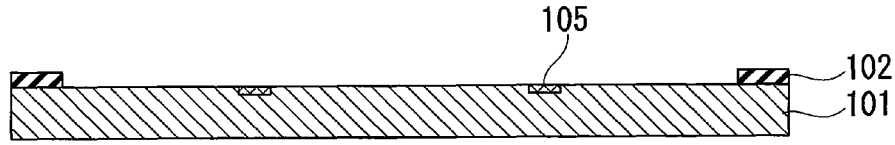
FIG. 12E is a cutting plane showing a fifth step of the manufacturing method of the electroacoustic transducer.

Phosphorus doping (or phosphorus ion implantation) is performed using a resist 104 suiting the shape of the opening 43*a* so as to form a plurality of ring-shaped conductive layers 201 on the surface of the substrate 101 having the recess S (see FIG. 12D), thus forming impurities-diffused regions (or n+-doped regions) 105. After completion of the doping, the resist 104 is removed from the substrate 101, which is then subjected to thermal treatment so as to form the conductive layers (or diffusion layers) 201 (see FIG. 12E).

Figure 12F:
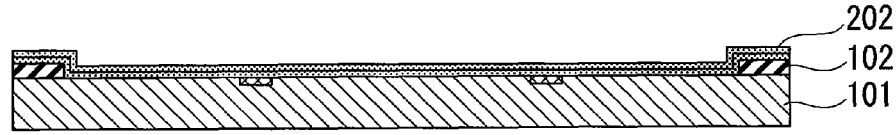
FIG. 12F is a cutting plane showing a sixth step of the manufacturing method of the electroacoustic transducer.
Figure 12G:
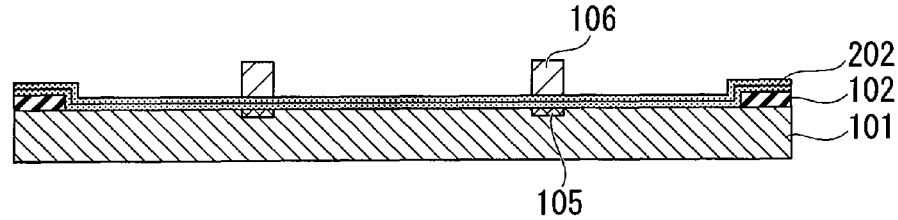
FIG. 12G is a cutting plane showing a seventh step of the manufacturing method of the electroacoustic transducer.
Figure 13A:
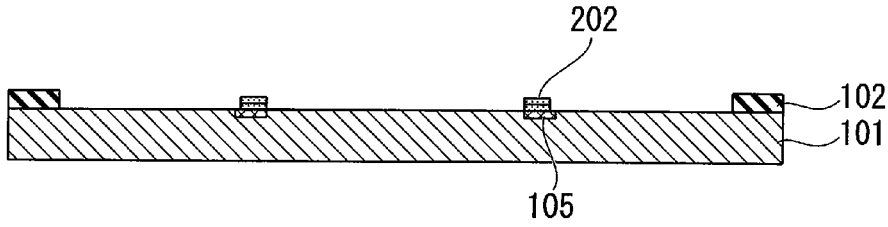
FIG. 13A is a cutting plane showing an eighth step of the manufacturing method of the electroacoustic transducer.

Insulating films 202 are formed on the conductive layers 201 in such a way that silicon oxide whose thickness ranges from 100 A° to 250 A° (realizing pad oxidation) is deposited on the surface of the substrate 101, and then, silicon nitride (realizing an insulating film) whose thickness ranges from 1000 A° to 3000 A° is deposited (see FIG. 12F). Herein, etching is selectively performed so as to process each of the silicon oxide and silicon nitride in a prescribed shape. Then, etching is performed using a resist mask 106 so as to process each of the foregoing layers in a prescribed shape (see FIG. 12G and FIG. 13A). After completion of the etching, the resist mask 106 is removed.

Figure 13B:
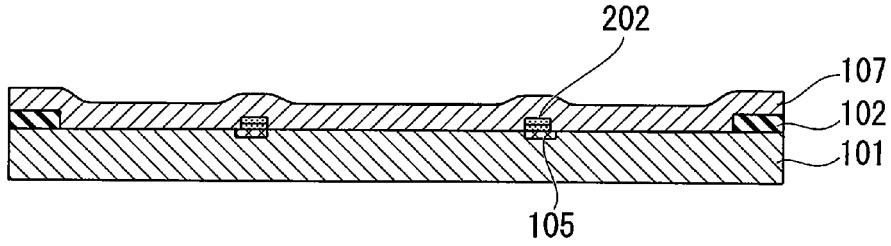
FIG. 13B is a cutting plane showing a ninth step of the manufacturing method of the electroacoustic transducer.
Figure 13C:
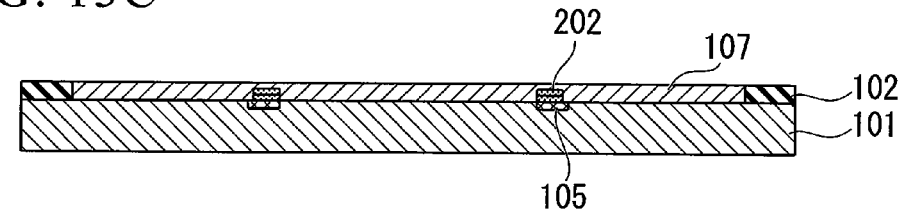
FIG. 13C is a cutting plane showing a tenth step of the manufacturing method of the electroacoustic transducer.

Thereafter, silicon oxide is deposited so as to form a stopper layer 107 (see FIG. 13B), which is subjected to planation by way of chemical mechanical polishing (CMP) as necessary (see FIG. 13C).

Figure 13D:
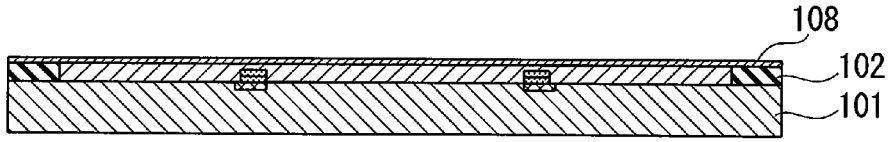
FIG. 13D is a cutting plane showing an eleventh step of the manufacturing method of the electroacoustic transducer.

A polysilicon film 108 of 0.5 μm thickness, which is doped with impurities such as phosphorus so as to form the diaphragm 51 and the elastic deformation portions 53, is deposited on the surface of the stopper layer 107 (see FIG. 13D).

Figure 13E:
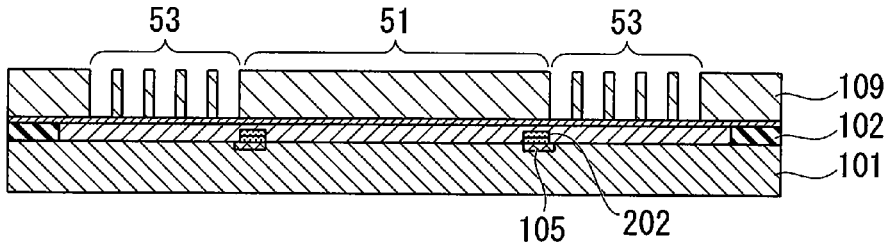
FIG. 13E is a cutting plane showing a twelfth step of the manufacturing method of the electroacoustic transducer.

Anisotropic etching such as reactive ion etching (RIE) is performed using a photoresist mask on the polysilicon film 108, which is thus selectively etched and processed into the diaphragm 51 and the elastic deformation portions 53 (see FIG. 13E).

Figure 14A:
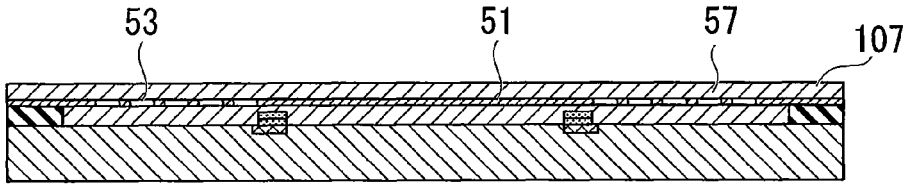
FIG. 14A is a cutting plane showing a thirteenth step of the manufacturing method of the electroacoustic transducer.

Silicon oxide is deposited to form a stopper layer 110 that covers the polysilicon film 108 subjected to etching. Herein, the planation of the stopper layer 110 is performed as necessary (see FIG. 14A). Incidentally, the polysilicon film 108 can be formed by way of deposition when the partition plates 57 preferably have conductivity.

Figure 14B:
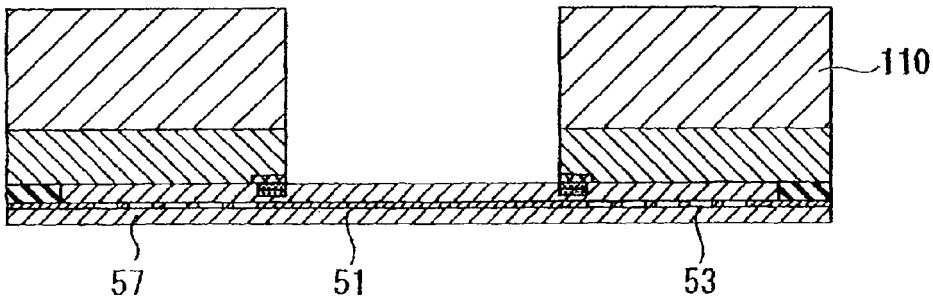
FIG. 14B is a cutting plane showing a fourteenth step of the manufacturing method of the electroacoustic transducer.

The upper substrate 70 can be formed by performing etching on the substrate 101 subjected to deposition. Herein, the backside of the substrate 101 is subjected to anisotropic etching such as Deep RIE in conformity with the opening 43*a* in such a way that the polysilicon film 108 is etched to expose the silicon oxide film (see FIG. 14B). The anisotropic etching is performed using a photoresist mask so as to realize the shapes of the partition plates 57 and the shapes of holes 300 on the surface of the substrate 101 in such a way that the polysilicon film 108 is subjected to selective etching so as to expose the silicon oxide film.

Figure 14C:
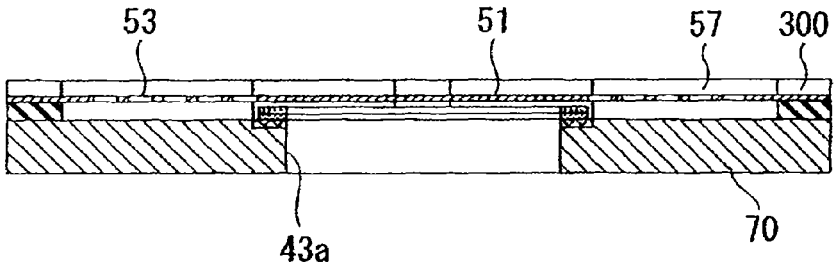
FIG. 14C is a cross-sectional view showing a fifteenth step of the manufacturing method of the electroacoustic transducer.

After completion of the etching on the silicon oxide (or pad oxidation) and the silicon nitride (or the insulating film) in conformity with the opening 43*a*, wet etching is performed using buffered hydrofluoric acid (or Buffered HF) so as so selectively remove the silicon oxide (or a stopper layer 110) in the periphery of the diaphragm 51 (see FIG. 14C). Thus, it is possible to form the upper substrate 70.

Figure 11A:
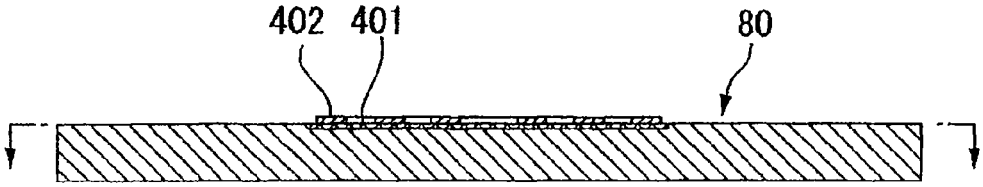
FIG. 11A is a cross-sectional view showing the constitution of the lower substrate.
Figure 11B:
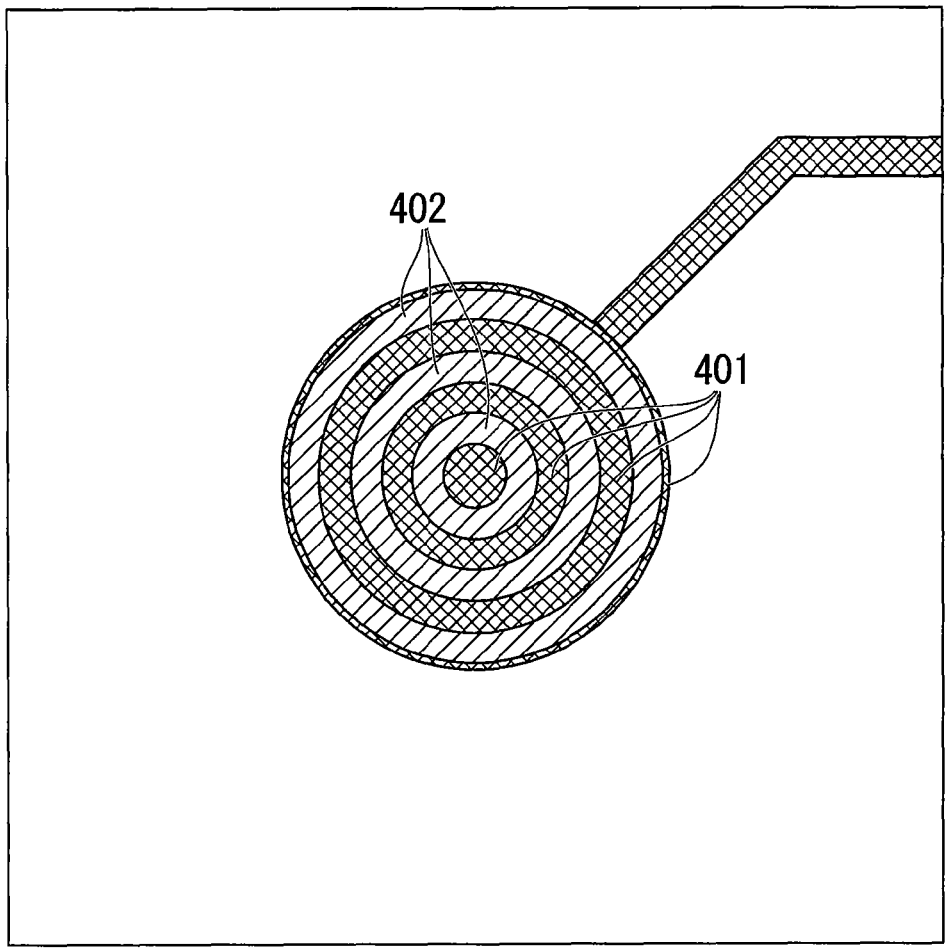
FIG. 11B is a plan view of the lower substrate.

Next, the lower substrate 80 is produced as shown in FIGS. 11A and 11B. Herein, phosphorus is doped on the surface of the polysilicon substrate 101 whose thickness ranges from 500 μm to 600 μm in conformity with the shape of the diaphragm 51 so as to form conductive layers 401, on which insulating layers 401 are partially formed.

By adhering the upper substrate 70 and the lower substrate 80 together, it is possible to completely produce the electroacoustic transducer 41.

In the aforementioned manufacturing method, the diaphragm 51 and the elastic deformation portions 53 are each formed using the polysilicon film doped with impurities such as phosphorus (P); but this is not a restriction. The diaphragm 51 can be formed using the silicon nitride film (SiN film) and silicon oxide nitride film (SiON film); it can be formed in a layered structure combining the SiN film and SiON film; it can be formed in a layered structure in which the polysilicon film is covered with the insulating film such as the SiN film and SiON film; and it can be formed using the silicon oxide film, for example. Then, the diaphragm 51, which is formed using the aforementioned insulating materials, is charged with either a positive polarity or a negative polarity by way of high voltage application or corona discharge, whereby it is possible to manufacture the electroacoustic transducer 41 of the electrostatic capacitance type by way of the semiconductor device manufacturing processes.

Each of the aforementioned embodiments and variations teaches a single electroacoustic transducer; but this is not a restriction. That is, a plurality of electroacoustic transducers can be arranged in an array, thus realizing a digital speaker for reproducing analog waveforms. Herein, an array including plural electroacoustic transducers can serve as a single speaker for producing a relatively high sound pressure. In addition, it is possible to simultaneously form a plurality of electroacoustic transducers on a single wafer by way of semiconductor device manufacturing processes.

In the aforementioned embodiments, the housings 3 and 43 are constituted of the fixed electrodes 7, the side walls 9 and 45, and the covers 11 and 47; but this is not a restriction. That is, the present invention requires that the electroacoustic transducer include the fixed electrode 7 and the cavity S1 opened in the exterior thereof. For example, it is possible to modify the aforementioned embodiments such that the side walls 9 and 45 and the covers 11 and 47 are integrally formed.

In the aforementioned embodiments, the diaphragms 5 and 51 are positioned substantially in parallel with the fixed electrode 7 and the electrode 49. The present invention requires that the diaphragms 5 and 51 be positioned substantially in parallel with the fixed electrode 7 and the electrode 49 in the balanced states of the diaphragm 5 and 51 and in the attracted and attached conditions in which the diaphragms 5 and 51 are attracted and attached to the fixed electrodes 7. In addition, it is required that, during vibration, the diaphragms 5 and 51 be substantially positioned in parallel with the fixed electrode 7 and the electrode 49 even when they are slightly inclined with respect to the fixed electrode 7 and the electrode 49.

The electroacoustic transducers 1 and 41 are not necessarily limited to speakers, but they can be used as microphones for detecting sounds. That is, the electroacoustic transducers 1 and 41 are capable of detecting sounds, which are transmitted to the diaphragms 5 and 51 via the openings 3*a* and 43*a* of the housings 3 and 43, by detecting vibrations of the diaphragms 5 and 51. In the electroacoustic transducer 1 of the first embodiment, for example, vibration of the diaphragm 5 can be detected in response to variations of electrostatic capacitance between the fixed electrode 7 and the electrode 29 of the diaphragm 5. In the electroacoustic transducer 41 of the second embodiment, vibration of the diaphragm 51 can be detected by detecting variations of electrostatic capacitance between the diaphragm 51 and the fixed electrode 7 or the electrode 49.

Lastly, the present invention is not necessarily limited to the aforementioned embodiments and variations, which can be further modified in a variety of ways within the scope of the invention defined by the appended claims.

What is claimed is:

1. An electroacoustic transducer comprising:

a housing having a cavity that has an opening in an exterior;

a fixed electrode having a planar shape, which is positioned opposite to the opening and which forms a part of the housing;

a diaphragm having an electrode, which is positioned between the opening and the fixed electrode; and an elastic deformation portion for supporting the diaphragm with respect to the housing and for allowing the diaphragm to vibrate in its thickness direction, wherein the fixed electrode is electrically insulated from the electrode of the diaphragm, wherein the diaphragm is distanced from the fixed electrode by means of the elastic deformation portion in a balanced state, and wherein the elastic deformation portion is subjected to elastic deformation so that the diaphragm comes in contact with the fixed electrode.

2. An electroacoustic transducer according to claim 1 further comprising a power unit for selectively applying either an AC voltage or DC voltage between the fixed electrode and the electrode of the diaphragm, wherein a frequency of the AC voltage is substantially identical to a resonance frequency of the diaphragm based on an elastic modulus of the elastic deformation portion and a weight of the diaphragm.

3. An electroacoustic transducer according to claim 2, wherein prior to generation of sound, the diaphragm is attracted and attached to the fixed electrode upon application of the AC voltage or the DC voltage.

4. An electroacoustic transducer according to claim 1, wherein at least one of the diaphragm and the fixed electrode is formed using an electret film.

5. An electroacoustic transducer comprising:

a housing having a cavity having an opening in an exterior;

a fixed electrode having a planar shape, which is positioned opposite to the opening and which fauns a part of the housing;

a diaphragm that is positioned between the opening and the fixed electrode; and an elastic deformation portion for supporting the diaphragm with respect to the housing and for allowing the diaphragm to vibrate in its thickness direction, wherein the diaphragm is distanced from the fixed electrode by means of the elastic deformation portion in a balanced state, wherein the elastic deformation portion is subjected to elastic deformation such that the diaphragm comes in contact with the fixed electrode, and wherein the diaphragm is composed of an electret, which is charged in either a positive polarity or a negative polarity.

* * * * *